US008439458B2

(12) United States Patent
Netzer

(10) Patent No.: US 8,439,458 B2
(45) Date of Patent: May 14, 2013

(54) HOUSING FOR AT LEAST PARTIALLY ACCOMMODATING A FURNITURE FITTING

(75) Inventor: Emanuel Netzer, Höchst (AT)

(73) Assignee: Julius Blum GmbH, Hochst (AT)

( * ) Notice: Subject to any disclaimer, the term of this patent is extended or adjusted under 35 U.S.C. 154(b) by 0 days.

(21) Appl. No.: 13/019,480

(22) Filed: Feb. 2, 2011

(65) Prior Publication Data

US 2011/0133618 A1 Jun. 9, 2011

Related U.S. Application Data

(63) Continuation of application No. PCT/AT2009/000230, filed on Jun. 10, 2009.

(30) Foreign Application Priority Data

Aug. 29, 2008 (AT) ..... GM459/2008

(51) Int. Cl.
*A47B 96/00* (2006.01)

(52) U.S. Cl.
USPC ..... 312/327; 312/319.2

(58) Field of Classification Search ..... 312/319.5, 312/319.6, 319.8, 322, 323, 325, 223.1, 139.1, 312/205, 319.2, 327; 16/242; 49/360; 248/298.1
See application file for complete search history.

(56) References Cited

U.S. PATENT DOCUMENTS 3,027,216 A * 3/1962 Van Alstyne et al. ..... 312/271
3,792,189 A * 2/1974 Stengel et al. ..... 174/69
4,651,960 A * 3/1987 Mauersberger et al. . 248/123.11
4,691,486 A * 9/1987 Niekrasz et al. ..... 52/172
4,756,054 A * 7/1988 Mitts et al. ..... 16/237
5,271,590 A * 12/1993 Rosen ..... 248/222.13
5,273,353 A 12/1993 Twellmann
5,458,412 A * 10/1995 Lee et al. ..... 312/309
5,625,533 A * 4/1997 Kim et al. ..... 361/679.21
5,678,886 A 10/1997 Infanti
5,904,411 A * 5/1999 Hayakawa ..... 312/319.2
5,971,514 A * 10/1999 Hayakawa ..... 312/319.2
6,371,584 B1 * 4/2002 Alreck ..... 312/235.1
6,546,880 B2 * 4/2003 Agee ..... 108/147
6,705,688 B2 * 3/2004 Tobishima ..... 312/223.1
6,793,259 B2 * 9/2004 Sano et al. ..... 296/155
6,812,407 B1 * 11/2004 Opperman ..... 174/100

(Continued)

FOREIGN PATENT DOCUMENTS

DE 93 10 935 9/1993
DE 102 06 176 8/2003

(Continued)

OTHER PUBLICATIONS

International Search Report issued Oct. 5, 2009 in International (PCT) Application No. PCT/AT2009/000230.

(Continued)

*Primary Examiner* — James O Hansen
*Assistant Examiner* — Hiwot Tefera
(74) *Attorney, Agent, or Firm* — Wenderoth, Lind & Ponack, L.L.P.

(57) ABSTRACT

A housing for at least partially accommodating a furniture fitting is designed such that it can be changed in length along a longitudinal axis of the housing.

19 Claims, 5 Drawing Sheets

U.S. PATENT DOCUMENTS

| | | | | |
|---|---|---|---|---|
| 6,956,735 | B2 * | 10/2005 | Lee et al. | 361/679.06 |
| 7,032,985 | B1 * | 4/2006 | Ichioka et al. | 312/319.2 |
| 7,240,974 | B2 * | 7/2007 | Hirtsiefer | 312/109 |
| 7,448,703 | B2 * | 11/2008 | Kung | 312/327 |
| 7,533,947 | B2 * | 5/2009 | Kim et al. | 312/402 |
| 7,854,413 | B2 * | 12/2010 | Yamamoto et al. | 248/49 |
| 7,952,883 | B2 * | 5/2011 | Hidaka | 361/726 |
| 8,033,622 | B2 * | 10/2011 | Oh et al. | 312/402 |
| 2003/0146425 | A1 * | 8/2003 | Drake et al. | 254/264 |
| 2004/0095047 | A1 * | 5/2004 | Salice | 312/332.1 |
| 2004/0100169 | A1 * | 5/2004 | Huber et al. | 312/319.5 |
| 2006/0087208 | A1 * | 4/2006 | Oh et al. | 312/402 |
| 2006/0164230 | A1 * | 7/2006 | DeWind et al. | 340/461 |
| 2007/0024166 | A1 * | 2/2007 | Sung | 312/319.9 |
| 2007/0180654 | A1 * | 8/2007 | Gasser | 16/242 |
| 2008/0018215 | A1 * | 1/2008 | Carden et al. | 312/404 |
| 2008/0048538 | A1 * | 2/2008 | Karg | 312/319.2 |
| 2008/0054771 | A1 * | 3/2008 | Brunnmayr | 312/323 |
| 2009/0261696 | A1 * | 10/2009 | Hollenstein et al. | 312/327 |
| 2009/0273262 | A1 * | 11/2009 | Brustle | 312/319.1 |
| 2010/0327710 | A1 * | 12/2010 | Kolton et al. | 312/223.1 |

FOREIGN PATENT DOCUMENTS

| | | |
|---|---|---|
| EP | 0 521 402 | 1/1993 |
| EP | 0 772 989 | 5/1997 |
| WO | 01/74198 | 10/2001 |
| WO | 2007/092968 | 8/2007 |
| WO | 2008/098267 | 8/2008 |

OTHER PUBLICATIONS

Austrian Patent Office Search Report dated Feb. 12, 2009 in Austrian Patent Application No. GM 459/2008.

* cited by examiner

Fig. 6a
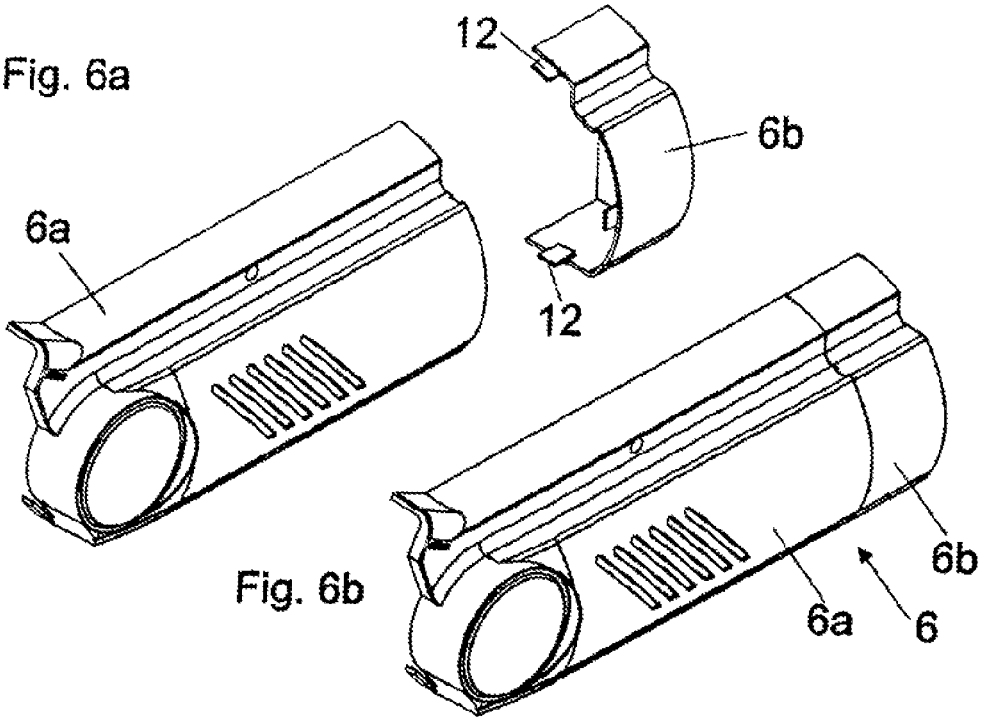
Fig. 6b
Fig. 7a
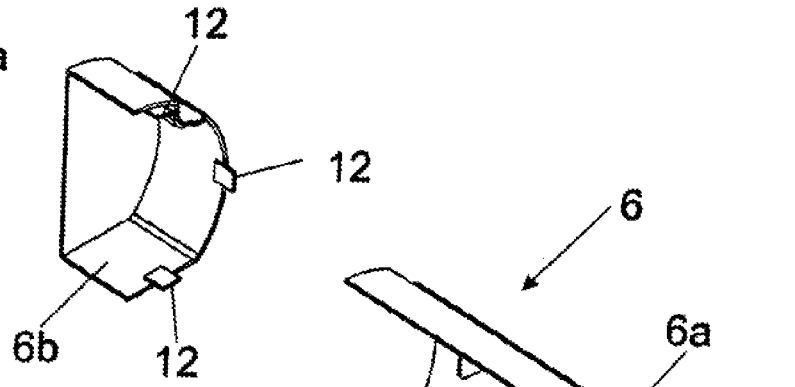
Fig. 7b
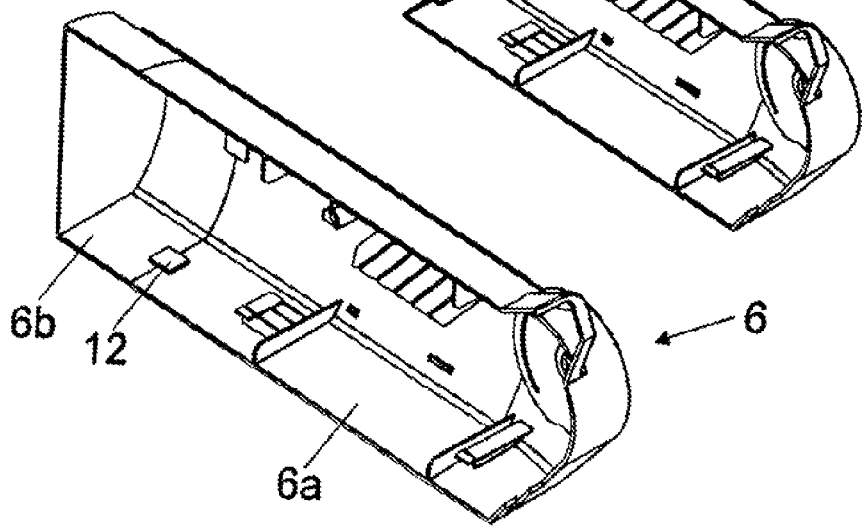

HOUSING FOR AT LEAST PARTIALLY ACCOMMODATING A FURNITURE FITTING

This application is a Continuation of International application No. PCT/AT2009/000230, filed Jun. 10, 2009, the entire disclosure of which is incorporated herein by reference.

BACKGROUND OF THE INVENTION (1) Field of the Invention

The present invention concerns a housing for at least partially accommodating a furniture fitting.

The invention further concerns a furniture fitting having a housing of the kind to be described as well as an article of furniture with such a furniture fitting.

(2) Description of Related Art

Furniture fittings often have electrically operated components such as for example a lighting arrangement and/or an electric drive for moving a movable furniture part. To supply electric power to those components in the mounted condition on an article of furniture, electric lines are laid on the article of furniture, which for that purpose have to be specifically fixed to the article of furniture. That requires an increased complication and expenditure in mounting them and also frequently has an adverse effect on visual appearance.

BRIEF SUMMARY OF THE INVENTION

It is therefore an object of the present invention to provide a housing of the general kind set forth in the opening part of this specification, avoiding the foregoing disadvantages.

According to the invention, the object is achieved in that the housing is adapted to be variable in length along a longitudinal axis of the housing.

A basic concept of the present invention is that the housing of the furniture fitting is also used as a cable guide system for possible electric lines. According to a possible embodiment of the invention, it can be provided that at least one modular housing portion is attached to a main housing of the furniture fitting, wherein a hollow space enclosed by the housing portion is in communicating relationship with the enclosed hollow space of the main housing in such a way that a cable system can be passed through the modular housing portions into the interior of the main housing (and possibly also therebeyond). In that way, possible power lines and/or measuring or control lines can be laid on the article of furniture without additional mounting complication and expenditure being required for same. In addition, the electric lines are concealed for the purpose of improved visual appearance. Lines can also be subsequently pulled therethrough without any problem.

In a preferred embodiment of the invention, it can be provided that the housing is adapted to be adjustable in length. In that respect, it can be provided that the housing has at least two housing portions being displaceable relative to each other. In a possible configuration it can be provided that the at least two housing portions can be displaced in a telescopic manner relative to each other. In that case, a first housing portion can be stationarily fixed to the article of furniture, with a second housing portion being supported movably relative to the first housing portion.

Alternatively, it can be provided that the housing has at least two housing portions which are to be fixed releasably to each other. In that case, it is possible to use modular components of different standard lengths and/or of predetermined shapes. In that respect it may be desirable for the at least two housing portions to be connected together by way of a releasable fixing device, preferably a mechanical latching connection. The mechanical latching connection can be in the form of a snap-action connection (for example with latching portions which are of a resilient nature or which can be acted upon by a spring) so that the at least two housing portions can be connected together and can be separated from each other again without any problem and without using a tool.

For reasons of attractive visual appearance it may be desirable if the at least two housing portions are substantially aligned with each other, preferably over their entire longitudinal extent. It is possible in that way to achieve a particularly compact construction.

The invention is found to be particularly desirable if at least one power consumer and/or voltage supply means is (are) arranged in at least one and preferably both housing portions. The power consumer can be for example an electric motor and/or at least one lighting arrangement. The power supply means can include one or more electric lines or also a busbar which is integrated into the housing portions, the effective length thereof being variable in dependence on the respective relative position of the at least two housing portions with respect to each other. In that respect it may be desirable if the length of the voltage supply means extends at least over the length of at least one of the two housing portions.

Desirable configurations are afforded if at least one part of the furniture fitting is arranged within the housing, wherein the furniture fitting can be in the form of an actuating mechanism for moving a furniture flap, a drawer pull-out-guide assembly or a furniture hinge. The furniture fitting according to the invention is thus characterised by a housing of the kind described.

The article of furniture according to the invention is characterised by at least one furniture fitting of the aforementioned kind. The housing in the mounted condition on an article of furniture is adapted to be variable in length in the direction of the depth of the body or carcass of the article of furniture—preferably being adjustable in length. In a possible embodiment of the invention it can be provided that the housing in the mounted condition on a furniture carcass extends at least over a large part of the carcass depth and preferably extends as far as the rear wall of the article of furniture. In that way the furniture fitting can be supplied with electric power by a power supply device directly adjacent to the rear wall without any lines in that case adversely affecting visual appearance.

BRIEF DESCRIPTION OF THE DRAWINGS

Further details and advantages of the present invention are described with reference to the specific description hereinafter. In the drawings:

FIGS. 7*a*, 7*b* show a perspective view from the rear of the two latchable housing portions of FIGS. 6*a* and 6*b*.

DETAILED DESCRIPTION OF THE INVENTION

Figure 1:
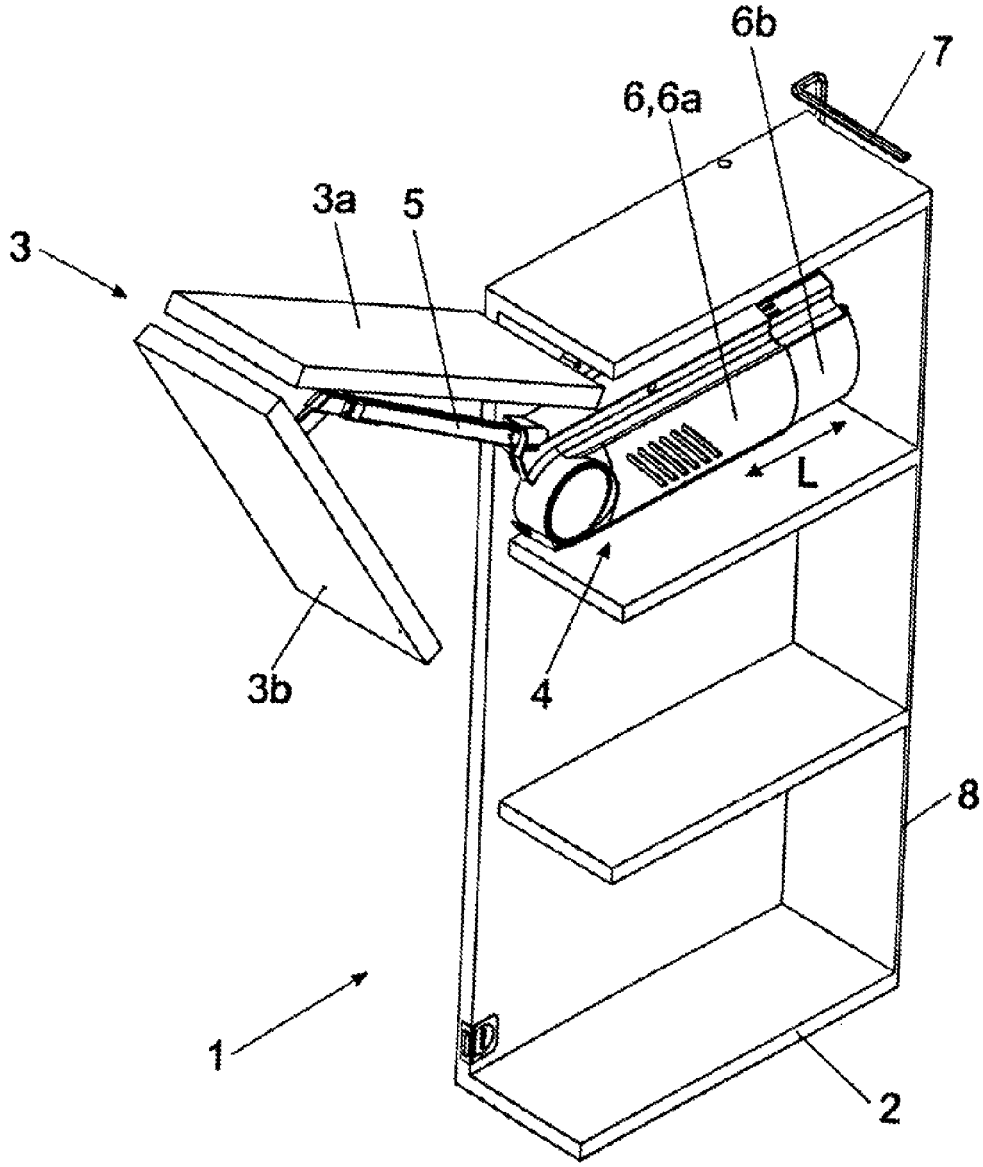
FIG. 1 shows a perspective view in a vertical section of an article of furniture with an actuating mechanism for moving a furniture flap, wherein the housing of the adjusting mechanism is adapted to be variable in length.

FIG. 1 shows a perspective view in vertical section of an article of furniture 1 in cupboard form. The article of furniture 1 has a furniture carcass 2 and a furniture part 3 movable relative thereto in the form of a furniture flap with two flap portions 3*a* and 3*b* which are pivotally connected to each other. In the illustrated embodiment the furniture fitting 4 is in the form of an adjusting mechanism for moving the flap portions 3*a*, 3*b*, wherein an adjusting arm 5 is pivotally mounted to the lower flap portion 3*b*. The fitting portion 4 in the form of an adjusting mechanism includes an elongate housing 6 in or on which there is provided an electric drive device (not shown here) for acting on the adjusting arm 5 and/or a lighting arrangement (not shown). The power supply is by way of a diagrammatically illustrated electric line 7. The power line 7 in the illustrated embodiment passes through a rear wall 8 of the article of furniture 1. Now the variable-length housing 6 of the adjusting mechanism which includes a stationary housing portion 6*a* and a housing portion 6*b* mounted displaceably relative thereto is of substantial significance. In that way, the movable housing portion 6*b* can be moved along a longitudinal axis L of the housing 6 so that the housing portion 6*b* preferably extends as far as the rear wall 8. The electric line 7 can thus be guided in concealed fashion through the cable passage formed in the housing portion 6*b* as far as the housing portion 6*a*. If appropriate, the electric line 7 can also be guided along the housing 6 by way of the adjusting arm 5 towards the flap portions 3*a* and 3*b* so that a power consumer (for example a lighting arrangement) disposed on the movable furniture part 3 can be supplied with electric power.

Figure 2:
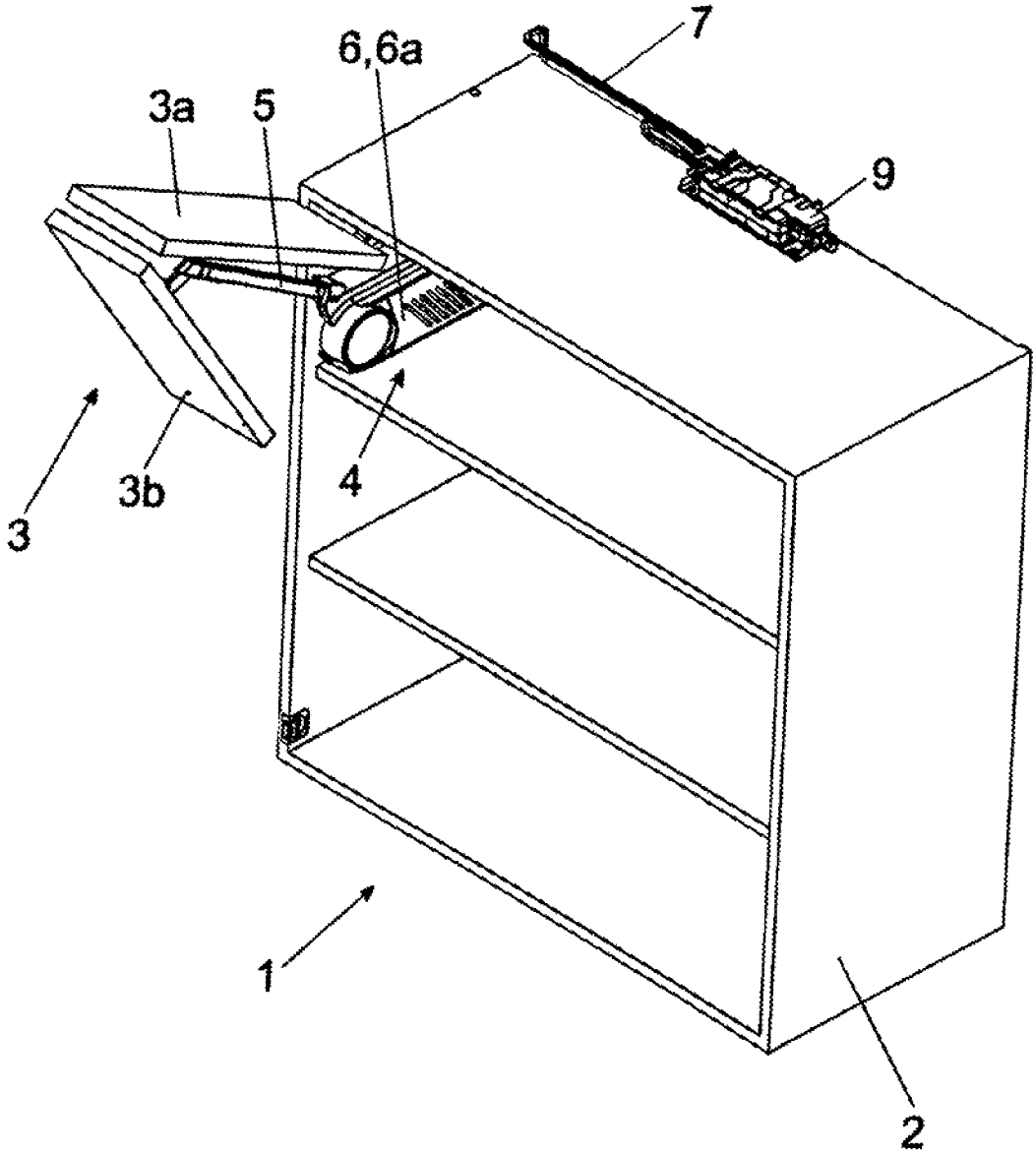
FIG. 2 shows a perspective view of the article of furniture of FIG. 1.

FIG. 2 shows the article of furniture 1 with the furniture carcass 2 and the movable furniture part 3 with the two flap portions 3*a* and 3*b* as a perspective view. Only a part of the movable furniture part 3 is shown for the sake of clarity of the drawing. Visible is the housing portion 6*a* of the housing 6 which is to be fixed to the side wall. A power consumer associated with the housing 6 or the movable furniture part 3 can be supplied with electric power by way of a power supply unit 9 and by way of the electric line 7.

Figure 3:
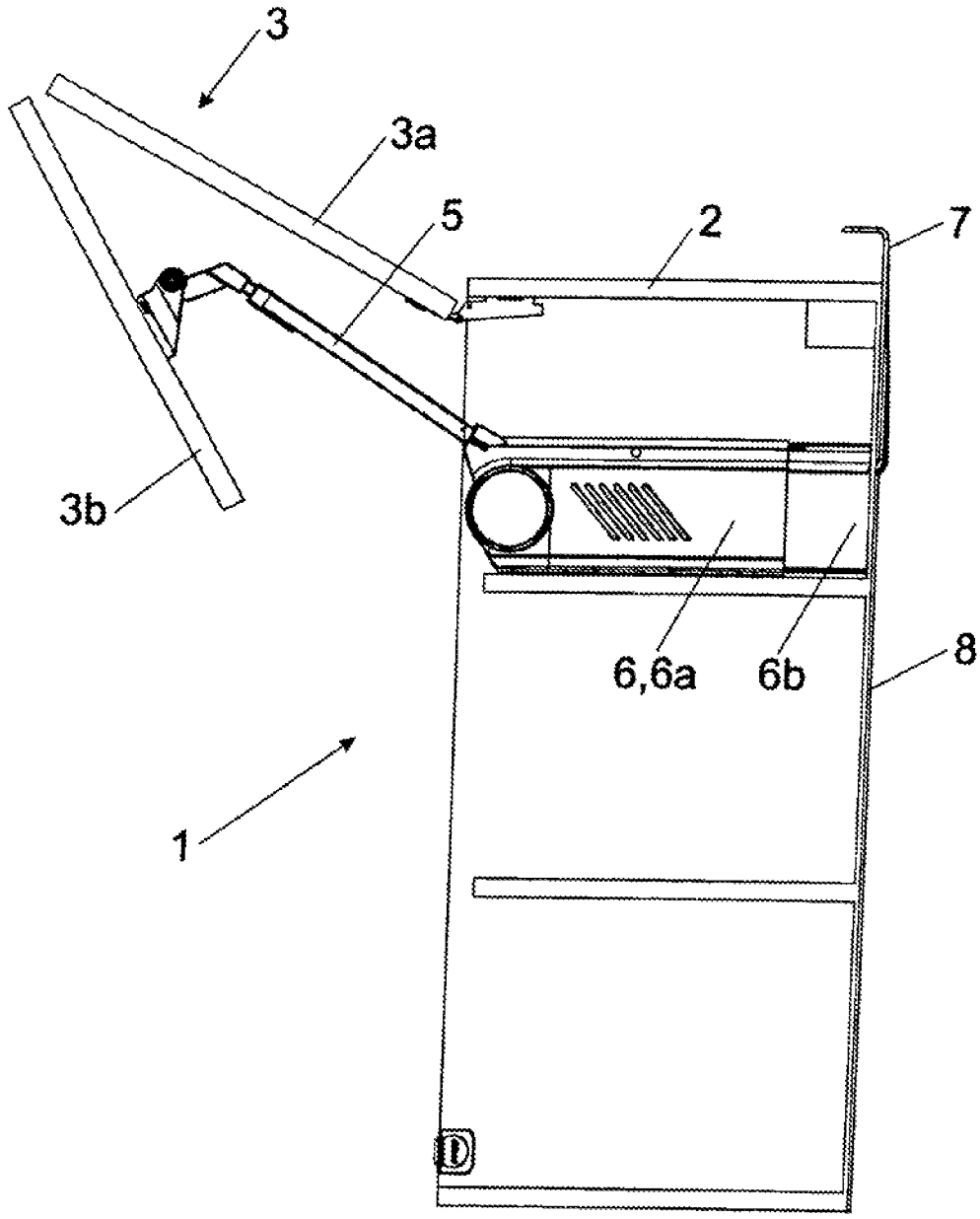
FIG. 3 shows a side view of the article of furniture with two housing portions displaceable relative to each other.
Figure 4A:
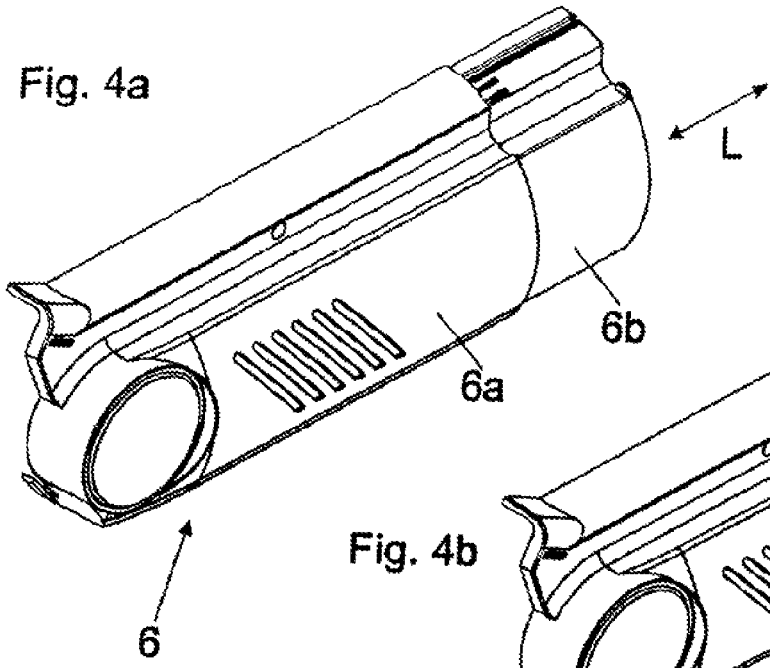
FIGS. 4*a*, 4*b* show a perspective view from the front of two housing portions displaceable relative to each other.
Figure 4B:
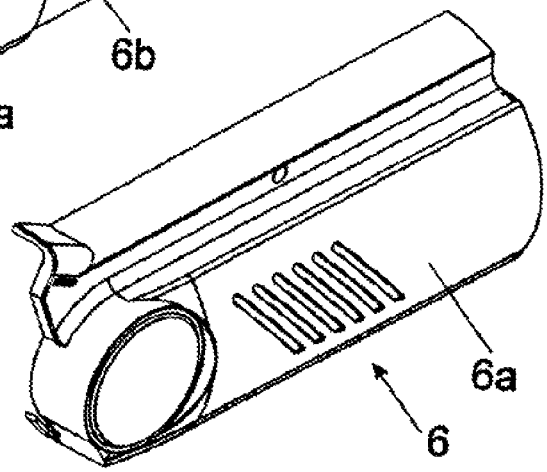

FIG. 3 shows a side view of the article of furniture 1 of FIG. 1 and FIG. 2. It is possible to see a housing portion 6*a* to be fixed to the side wall, with the housing portion 6*b* displaceable relative thereto. In the mounted condition on the article of furniture 1, the housing portion 6*b* bears with an end against the rear wall 8 of the article of furniture 1 so that the electric line 7 cannot be seen at all in the interior of the furniture carcass 2. FIG. 4*a* shows a perspective view from the front of a possible embodiment of the housing 6. The housing 6 has at least two housing portions 6*a*, 6*b* mounted displaceably relative to each other along a longitudinal axis L. The two housing portions 6*a*, 6*b* are substantially aligned over their entire longitudinal extent so that this permits a compact construction to be achieved. FIG. 4*b* shows the retracted condition of the displaceably mounted housing portion 6*b* so that the second housing portion 6*b* is substantially completely accommodated in the first housing portion 6*a*.

Figure 5A:
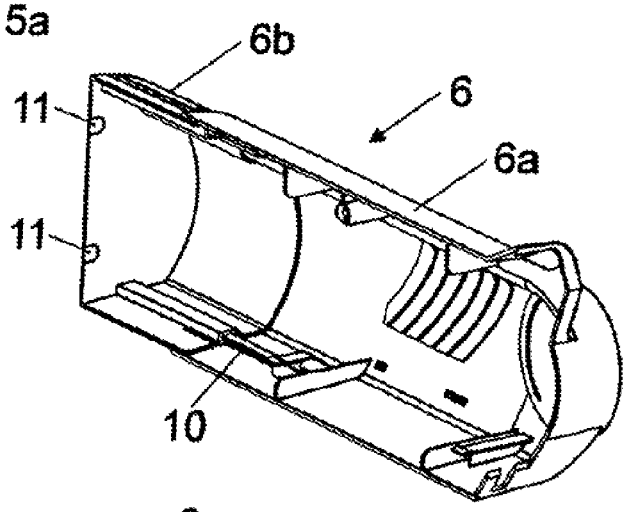
FIGS. 5*a*, 5*b* show a perspective view from the rear of the two housing portions of FIGS. 4*a* and 4*b*, FIGS. 6*a*, 6*b* show a perspective view from the front of two housing portions releasably latchable to each other.
Figure 5B:
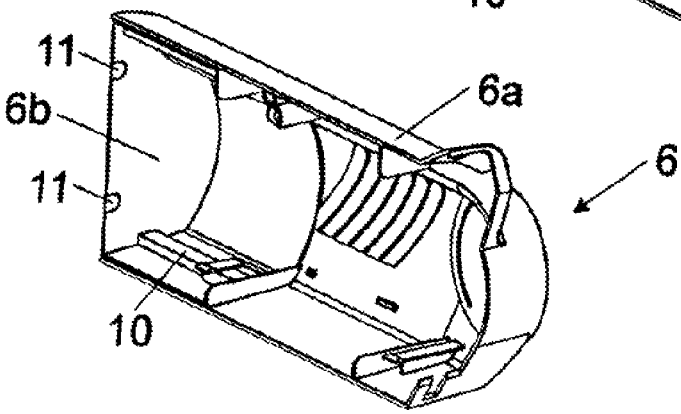

FIGS. 5*a* and 5*b* show a perspective view from the rear of the housing portions 6*a* and 6*b* in FIGS. 4*a* and 4*b*. FIG. 5*a* shows the extended condition of the movable housing portion 6*b*. The housing portion 6*b* is linearly displaceable relative to the housing portion 6*a* which is fixed with respect to the furniture carcass, by way of at least one guide device 10 so that the risk of the second housing portion 6*b* tilting is substantially reduced. FIG. 5*b* shows the retracted position of the housing portion 6*b* relative to the housing portion 6*a*. The housing portion 6*b* has predetermined breaking-points 11 for passing the electric line 7 therethrough.

FIG. 6*a* shows a further embodiment of the invention with two housing portions 6*a* and 6*b* which can be latched to each other. For that purpose there are provided mechanical latching connections 12 so that the housing portion 6*b* can be snapped on to the housing portion 6*a*. In this case the second housing portion 6*b* can be of different nominal lengths so that the housing 6 can be passed as far as the rear wall 8 of the article of furniture 1 by suitable selection of the length of the second housing portion 6*b*. FIG. 6*b* shows the housing portions 6*a* and 6*b* which are latched together, wherein the housing portion 6*b* can be dismantled again without any problem by applying manual pressure.

FIGS. 7*a* and 7*b* show similar views to FIGS. 6*a* and 6*b* but as a perspective view from the rear. The second housing portion 6*b* can also be formed by a plurality of modular housing portions 6*b* which can be connected together.

The present invention is not limited to the illustrated embodiments but includes or extends to all variants and technical equivalents which can fall within the scope of the claims appended hereto. The positional references adopted in the description such as for example up, down, lateral and so forth are also related to the directly described and illustrated Figure and are to be appropriately transferred to the new position upon a change in position. The invention was described by means of the embodiment with an adjusting mechanism for moving a furniture flap. It will be appreciated that it is also in accordance with the invention that a drawer extension guide and a furniture hinge can have a housing of the kind described.

The invention claimed is:

1. A furniture fitting comprising:

a housing which is variable in length along a longitudinal axis of the housing, the housing having a stationary housing portion and a movable housing portion which is displaceable relative to the stationary housing portion or releasably fixed to the stationary housing portion;

a drive device disposed within the housing;

an electric line for supplying power to the drive device; and an adjusting arm for moving a flap, wherein the adjusting arm pivots about an axis of rotation and is pivotally driven by the drive device to move the flap, the axis of rotation being perpendicular to a longitudinal axis of the adjusting arm, wherein the stationary housing portion and the moving housing portion define a continuous hollow space, wherein the electric line is disposed in and extends through the continuous hollow space and the stationary housing portion, and wherein the furniture fitting is a furniture hinge for moving the flap.

2. The furniture fitting of claim 1, wherein the movable housing portion is telescopically mounted to the stationary housing portion.

3. The furniture fitting of claim 1, wherein the movable housing portion is releasably fixed to the stationary housing portion.

4. The furniture fitting of claim 1, wherein the stationary housing portion and the movable housing portion are substantially aligned with each other over their entire longitudinal extent.

5. The furniture fitting of claim 1, wherein the movable housing portion is connected to the stationary housing portion by at least one releasable fixing device.

6. The furniture fitting of claim 5, wherein the at least one releasable fixing device is a mechanical latching connection.

7. An item of furniture comprising:

a furniture body;

a movable furniture part which is movable relative to the furniture body; and a furniture fitting which includes (i) a housing which is variable in length along a longitudinal axis of the housing, the housing having a stationary housing portion and a movable housing portion which is displaceable relative to the stationary housing portion or releasable fixed to the stationary housing portion;

(ii) a drive device disposed within the housing;

(iii) an electric line for supplying power to the drive device; and (iv) an adjusting arm for moving a furniture part, wherein the adjusting arm pivots about an axis of rotation and is pivotally driven by the drive device to move the furniture part, the axis of rotation being perpendicular to a longitudinal axis of the adjusting arm, wherein the stationary housing portion and the moving housing portion define a continuous hollow space, wherein the electric line is disposed in and extends through the continuous hollow space and the stationary housing portion, wherein the stationary housing portion is fixed to a side wall of the furniture body, wherein the adjusting arm is connected to the movable furniture part for displacing the movable furniture part relative to the furniture body, and wherein the drive device displaces the adjusting arm and the movable furniture part relative to the stationary housing portion and the movable housing portion.

8. The item of furniture of claim 7, wherein the movable housing portion is adjustable to vary the length of the housing along a longitudinal axis of the housing for concealing the electric line along an entirety of a length of the side wall of the furniture body.

9. The item of furniture of claim 7, wherein the movable furniture part is a flap, and the furniture fitting is a furniture hinge for moving the flap.

10. The item of furniture of claim 7, wherein the movable housing portion is telescopically mounted to the stationary housing portion.

11. The item of furniture of claim 7, wherein the movable housing portion is releasably fixed to the stationary housing portion.

12. The item of furniture of claim 7, wherein the movable housing portion is connected to the stationary housing portion by at least one releasable fixing device.

13. The item of furniture of claim 12, wherein the at least one releasable fixing device is a mechanical latching connection.

14. The item of furniture of claim 7, wherein the stationary housing portion and the movable housing portion are substantially aligned with each other over their entire longitudinal extent.

15. The item of furniture of claim 7, wherein the drive device includes at least one electric motor which moves the movable furniture part.

16. The item of furniture of claim 7, wherein the housing extends to a rear wall of the furniture body.

17. The item of furniture of claim 7, wherein the drive device is disposed in the stationary housing portion.

18. The item of furniture of claim 7, wherein the housing is mounted on the side wall of the furniture body and the continuous hollow space is confined between the housing and the side wall of the furniture body over an entire length of the housing, and wherein the adjusting arm extends outside the housing.

19. An item of furniture comprising:

a furniture body;

a movable furniture part which is movable relative to the furniture body; and a furniture fitting which includes (i) a housing which is variable in length along a longitudinal axis of the housing, the housing having a stationary housing portion and a movable housing portion which is displaceable relative to the stationary housing portion or releasably fixed to the stationary housing portion, (ii) a drive device disposed within the housing, (iii) an electric line for supplying power to the drive device, and (iv) an adjusting arm for moving the movable furniture part, wherein the adjusting arm pivots about an axis of rotation and is pivotally driven by the drive device to move the movable furniture part, the axis of rotation being perpendicular to a longitudinal axis of the adjusting arm, wherein the stationary housing portion and the moving housing portion define a continuous hollow space, wherein the electric line is disposed in and extends through the continuous hollow space and the stationary housing portion, wherein the stationary housing portion is fixed to a side wall of the furniture body, wherein the adjusting arm is connected to the movable furniture part for displacing the movable furniture part relative to the furniture body, wherein the drive device displaces the adjusting arm and the movable furniture part relative to the stationary housing portion and the movable housing portion, and wherein the movable housing portion extends from the stationary housing toward a rear wall of the furniture body, and the electric line passes through the rear wall of the furniture body and extends through both the movable housing portion and the stationary housing portion.

* * * * *